US006170410B1

(12) United States Patent
Gioacchini et al.

(10) Patent No.: US 6,170,410 B1
(45) Date of Patent: Jan. 9, 2001

(54) FURNITURE SYSTEM COMPRISING WORKTOPS THAT CAN BE EQUIPPED WITH FITTINGS

(75) Inventors: Nilo Gioacchini, Pelago; Giuseppe Mittino, Magenta, both of (IT)

(73) Assignee: Castelli S.p.A., Ozzano Dell 'Emilia (IT)

( * ) Notice: Under 35 U.S.C. 154(b), the term of this patent shall be extended for 0 days.

(21) Appl. No.: 09/284,686

(22) PCT Filed: Oct. 14, 1997

(86) PCT No.: PCT/EP97/05637

§ 371 Date: Jun. 14, 1999

§ 102(e) Date: Jun. 14, 1999

(87) PCT Pub. No.: WO98/16136

PCT Pub. Date: Apr. 23, 1998

(30) Foreign Application Priority Data

Oct. 15, 1996 (IT) ..... BO96A0512

(51) Int. Cl.[7] ..... A47B 13/00

(52) U.S. Cl. ..... 108/153.1; 108/50.01; 108/64

(58) Field of Search ..... 108/153.1, 50.01, 108/50.07, 64; 312/195, 196, 223.3, 223.6

(56) References Cited

U.S. PATENT DOCUMENTS 2,705,179 * 3/1955 Hodgin ..... 108/64 X
4,645,878 * 2/1987 Hilger et al. ..... 108/64 C
4,852,500 8/1989 Ryburg et al. .
5,078,055 * 1/1992 Bellini et al. ..... 108/64
5,287,666 2/1994 Frascaroli et al. .
5,486,042 1/1996 Heisler et al. .
5,528,996 * 6/1996 Edwards et al. ..... 108/64
5,715,760 2/1998 Frascaroli et al. .
5,943,966 * 8/1999 Machado et al. ..... 108/64
5,947,628 * 9/1999 Hansen ..... 108/64 X
5,967,058 * 10/1999 Ambrose et al. ..... 108/64
5,974,985 * 11/1999 Flototto et al. ..... 108/50.01 X
5,988,077 * 11/1999 Balderi ..... 108/64

FOREIGN PATENT DOCUMENTS 0 534 054 A1 3/1993 (EP) .

* cited by examiner

*Primary Examiner*—Jose V. Chen
(74) *Attorney, Agent, or Firm*—Flynn, Thiel, Boutell & Tanis, P.C.

(57) ABSTRACT

A furniture system including at least one worktop which mounts thereon a plurality of legs adjustable in height. The legs are connected to respective support plates recessed in the underside of the worktop. At least one linear guide is recessed into the underside of the worktop for the mounting of accessories on the worktop. A plurality of worktops can be mounted in spaced relation from a support surface by a common leg via support arms. The worktops can be joined together in either a flush arrangement or separated from one another. In the separated configuration, a tray can be fitted in the space between two adjacent worktops for the housing of cables, electrical sockets and the like.

29 Claims, 14 Drawing Sheets

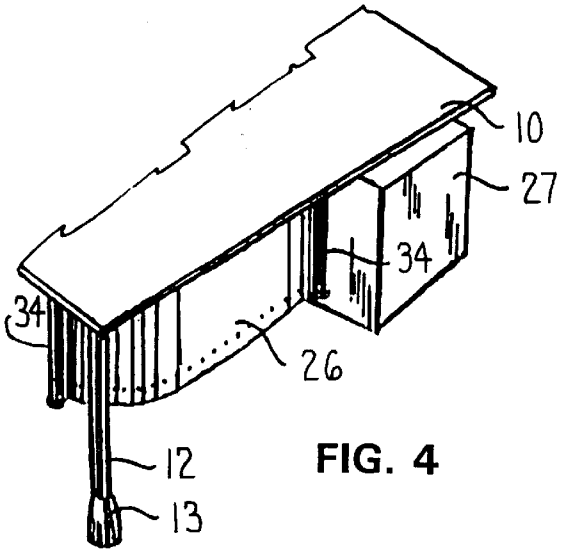
FIG. 4
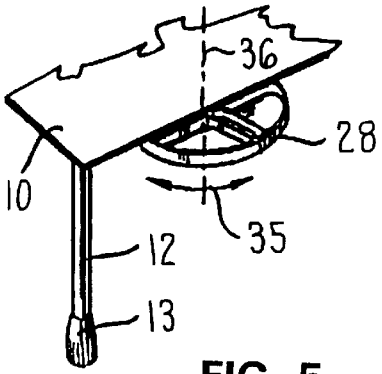
FIG. 5
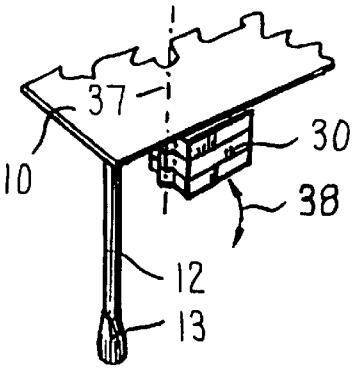
FIG. 6
FIG. 7
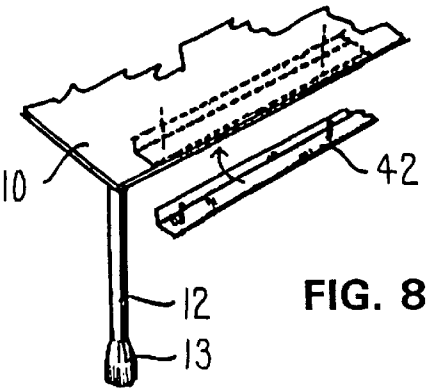
FIG. 8
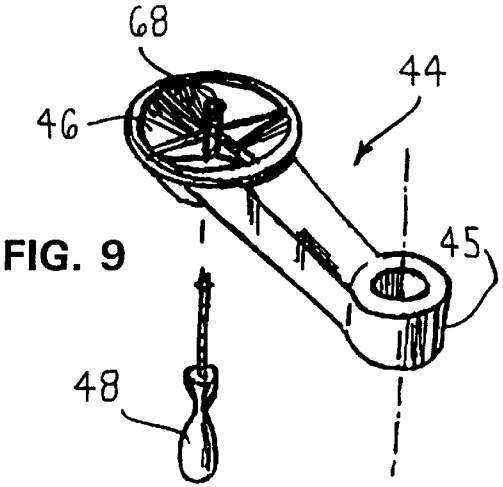
FIG. 9

FURNITURE SYSTEM COMPRISING WORKTOPS THAT CAN BE EQUIPPED WITH FITTINGS

FIELD OF THE INVENTION

The subject of this invention is a furniture system comprising worktops that can be equipped with fittings.

BACKGROUND OF THE INVENTION

Various furniture systems exist, particularly for offices, comprising worktops that can be combined and arranged in various ways to form furniture configurations ranging from a single table to complex furniture units for offices with several work stations. One of these furniture systems of the known type is described in the patent application EP-A-0670125 by the same applicant.

The known types of furniture systems generally comprise structural elements that can be combined to form a load bearing frame, comprising vertical uprights and cross-bars, on which the worktops and accessories are then fitted, such as partitions screens, shelves, trays and the like.

In addition to the need to be able to create furniture configurations of varying degrees of complexity during the design stage, the necessity is increasingly felt of being able to subsequently modify existing furniture configurations, without having to interrupt working activities for an extended period or having to rely on specialised personnel for the modification. Moreover, the common use of electrically-operated office machines and of cabled data networks increases the need for furniture systems in which the positioning of electrical cables, their inspection, maintenance and replacement do not involve difficult operations for those concerned due to the awkward or inaccessible position of the cables.

In the known types of furniture systems the requirements indicated above are only partially dealt with and resolved, and the main obstacle for the construction and flexibility and modification of furniture configurations is the presence of the above-mentioned load-bearing frame. Moreover, this load-bearing frame, consisting of a grid of vertical uprights and cross-bars, often makes the positioning of electrical cables for office machines difficult.

The aim of this invention is to satisfy the above-mentioned requirements, overcoming the limitations of the known type of modular furniture systems.

In order to achieve this aim, the invention relates to a furniture system comprising at least one worktop and a plurality of legs to support the at least one worktop, characterised in that the at least one worktop comprises a plurality of support plates fixed to its underside in predetermined positions, and linear guide means positioned on the underside of the worktop between at least two support plates, close to at least one edge of the worktop.

In order to achieve the aforesaid aim, the invention also relates to a furniture system of the above-mentioned type, characterised in that the at least one worktop comprises a plurality of support plates fixed to its underside in predetermined positions, and support arms for the overhand mounting of the worktops on the legs, each support arm comprising a support portion that can be fixed to one of the support plates of the worktop, and a coupling portion opposite the support portion and used to fit the support arm in the upper end of a leg.

BRIEF DESCRIPTION OF THE DRAWINGS

Additional characteristics and advantages of the invention will emerge from the following detailed description of a preferred embodiment, with reference to the attached drawings, provided merely as non-limiting examples, in which:

FIGS. 4 to 8 show a series of accessories in perspective, which can be fitted to the underside of the worktops, FIG. 9 is a perspective diagrammatic view of an arm for the fitting of accessories to the worktops.

DETAILED DESCRIPTION

Figure 1:
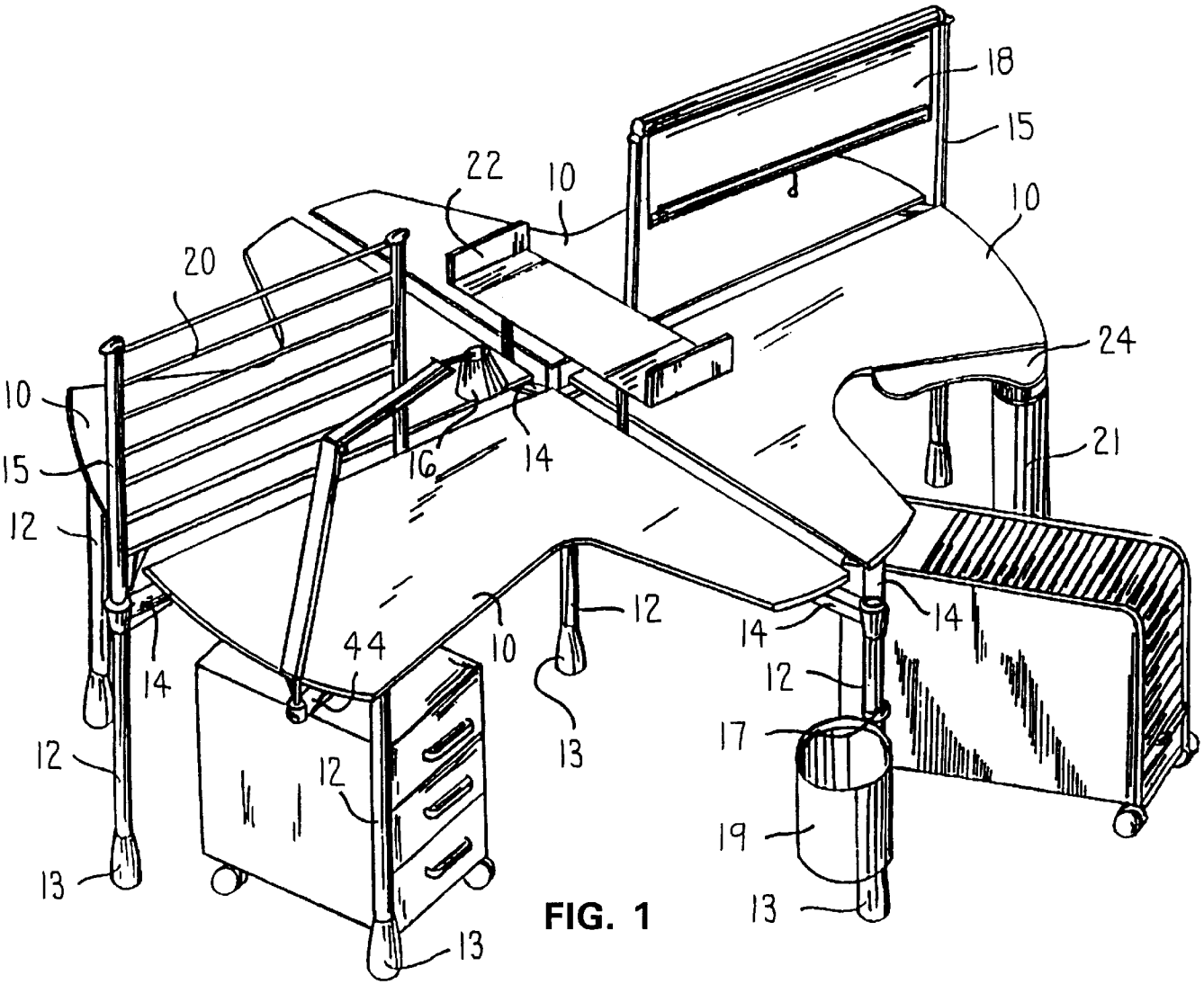
FIGS. 1, 2 and 3 show three different examples of furniture configurations in perspective, realised by means of the modular furniture system as per this invention.

With reference to FIG. 1, a furniture system according to this invention comprises worktops, generally indicated with the reference number 10, supported by legs 12 terminating with feet 13, preferably adjustable in height. The legs 12 are fitted directly to the underside of the worktops 10, or support the overhang worktops with the interposition of support arms 14. In this second case, several support arms 14 can be fitted on the same leg 12. In the example in FIG. 1, which shows a furniture configuration with four worktops grouped in an island or "cluster", the central leg 12 is common to all four worktops which, close to the central leg, have a 90° corner profile.

The worktops 10 can be equipped, for example by means of arms 44 better described below, with various accessories such as for example a lamp 16, a partition screen 18, a rack or grid 20, a shelf 22, an extension flap 24, and the like. Vertical extensions 15 can be fitted on the legs 12 with support arms 14, to hold the above-mentioned accessories. It is also possible to fit accessories such as a waste-paper bin 19 or a cable-cover 21 to each leg 12, by means of clamps 17.

Figure 2:
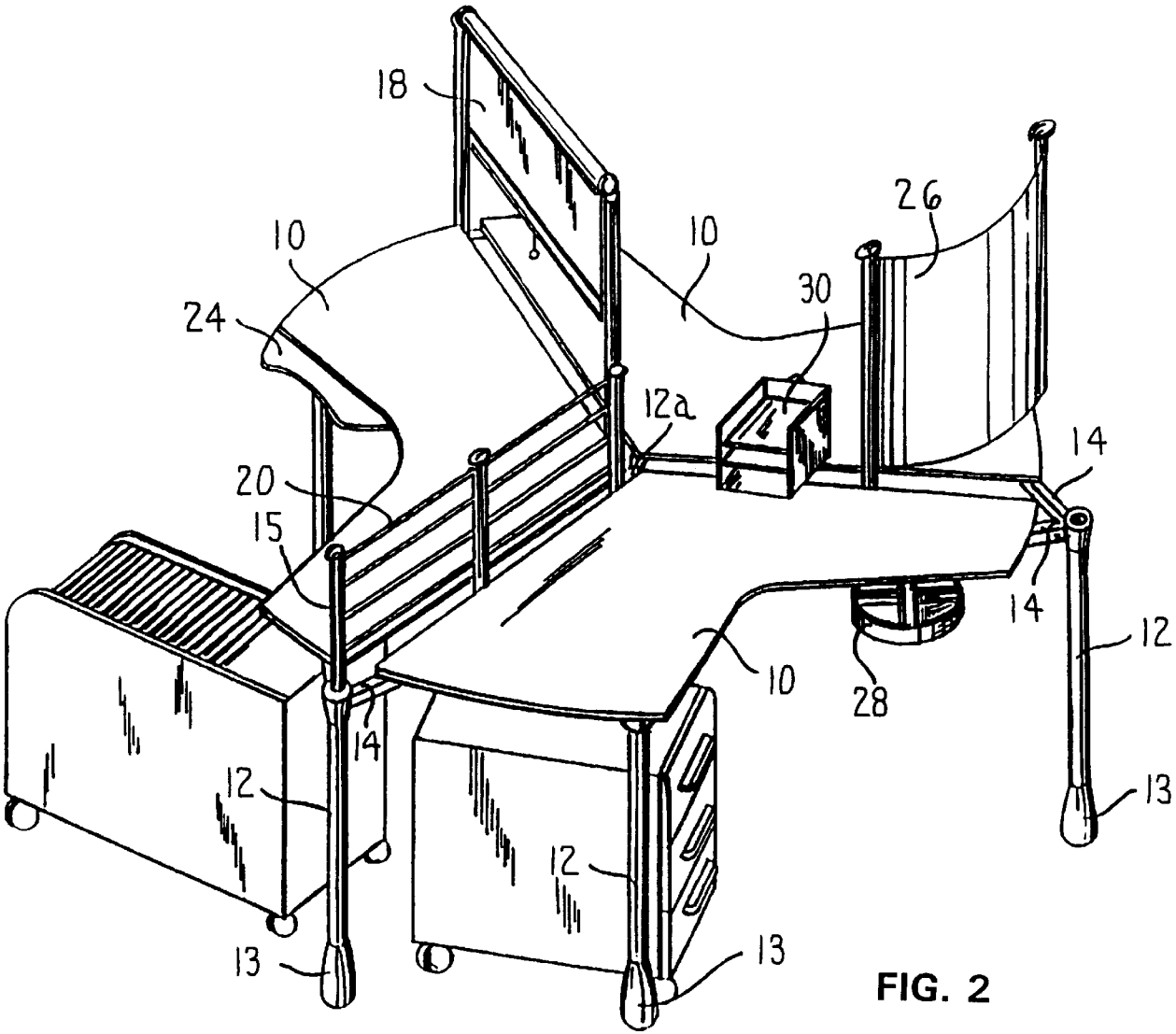

FIG. 2 shows another furniture configuration, in particular a cluster one, which can be created with the furniture system as per this invention, comprising three work stations obtained by grouping three worktops 10 with two of their sides angled at 120° around a central leg 12*a*. FIG. 2 also shows other examples of accessories that can be fixed to the worktops 10 or to the vertical extensions 15, such as a flexible screen 26, a storage tray 28 and a document tray 30.

Figure 3:
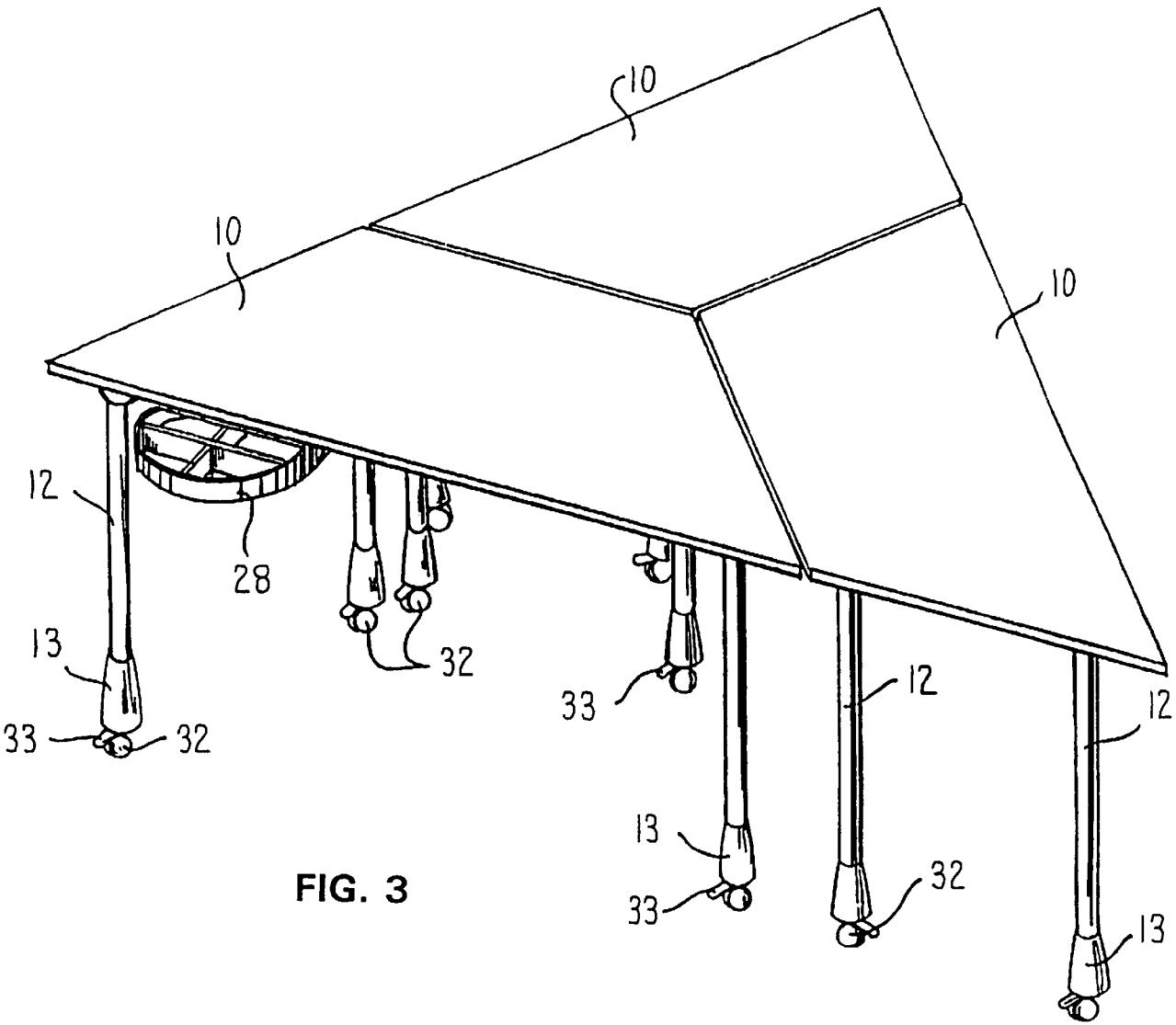

FIG. 3 shows a further possible furniture configuration, in which three worktops 10 are placed together to form a larger sized table. Each leg 12 is fitted on a castor 32, preferably equipped with a locking brake 33. In the furniture configuration shown in FIG. 3, the worktops 10 can be coupled together and locked by means which will be discussed in detail below.

As indicated above, a variety of accessories can be fitted to the underside of the worktops 10, as shown in FIGS. 4 to 8. In particular, FIG. 4 shows a worktop underneath which the flexible screen 26 and a set of drawers 27 are fitted. Two bars 34 are fixed to the underside of the worktop 10 and support the ends of the flexible screen 26.

FIG. 5 shows the storage tray 28 fitted underneath the worktop 10 so that it can be pulled out or stowed away below the worktop by rotating it in the direction shown by the arrows 35 around the vertical hinged axis 36. In a similar way, the document tray 30 in FIG. 6 and a compact-disk holder 40 in FIG. 7 are fitted underneath the worktops 10 and rotate with respect to their vertical axes 37, so that they can be pulled out or stowed away by rotating them in the direction of the arrows 38. FIG. 8 shows a cable duct 42 that can be fixed underneath the worktop 10 in the position indicated by the dashed line.

The accessories can also be fixed to the worktops 10 by means of the arm 44 illustrated diagrammatically in FIG. 9. The arm 44 comprises a cup-shaped part 46 perforated axially for the insertion of a fixing screw 68 which, as better described below, allows the arm 44 to be fixed quickly and easily to the underside of the table, for example using just a screwdriver 48 or a similar tool. The end of the arm 44 opposite to the cup-shaped portion 46 terminates with a socket end 45 for the insertion of vertical accessory-holder rods, as can be seen in the examples in FIGS. 10 to 15.

Figure 11:
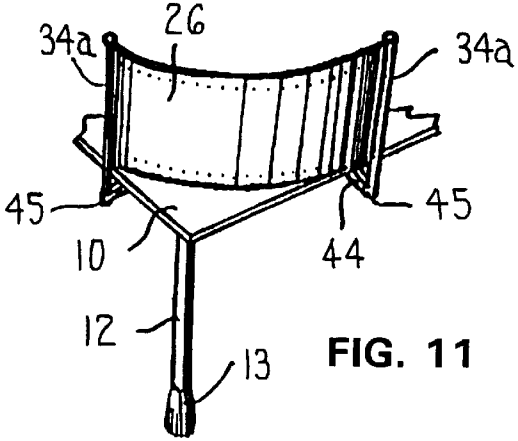
Figure 10:
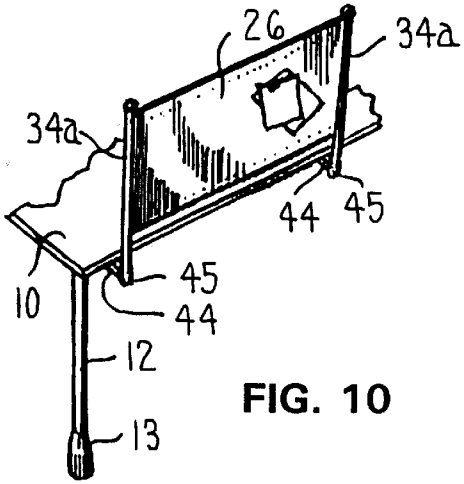

In particular, FIGS. 10 and 11 show flexible screens 26, each supported by two vertical rods 34*a*. the lower ends of which are inserted in the socket ends 45 of the arms 44. In FIG. 10, the screen 26 is fitted along one side of the worktop 10, while in FIG. 11 the screen 26 is arranged in a curved configuration around a corner of the worktop 10.

Figure 12:
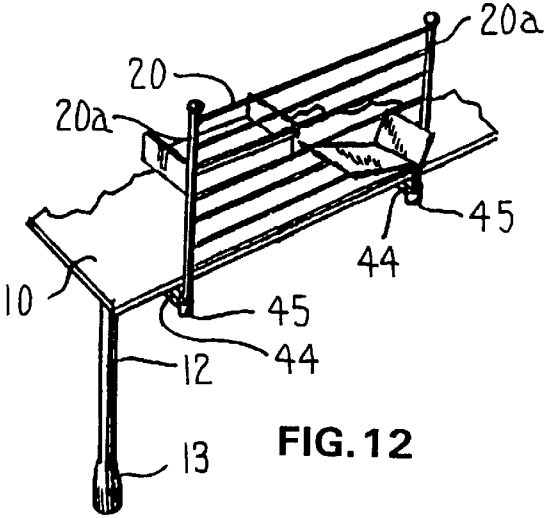
FIGS. 10 to 15 show a series of accessories in perspective, which can be fitted to the worktops by means of the arm in FIG. 9.
Figure 15:
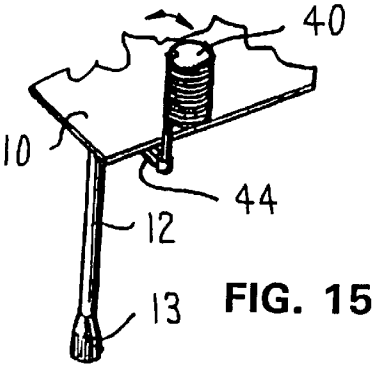
Figure 14:
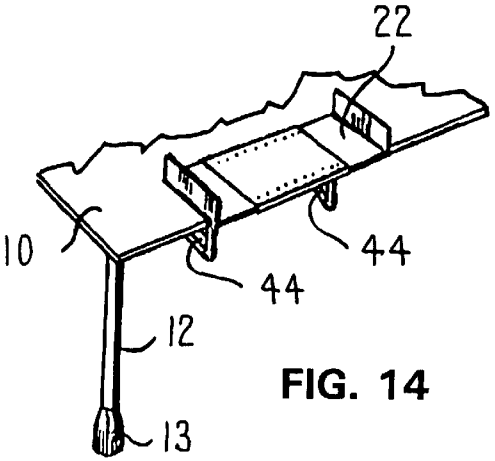
Figure 13:
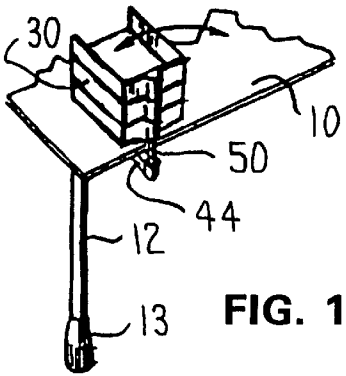

FIG. 12 shows an example of a rack or grid 20 that can be used to attach objects to, comprising two uprights 20*a* inserted in the socket ends 45 of the arms 44. FIG. 13 shows a series of document trays 30 pivotally mounted on a support rod 50 held by the arm 44. FIG. 14 shows a shelf 22 supported by the arms 44, while FIG. 15 shows a compact-disk holder 40 pivotally mounted on the arm 44.

Figure 17:
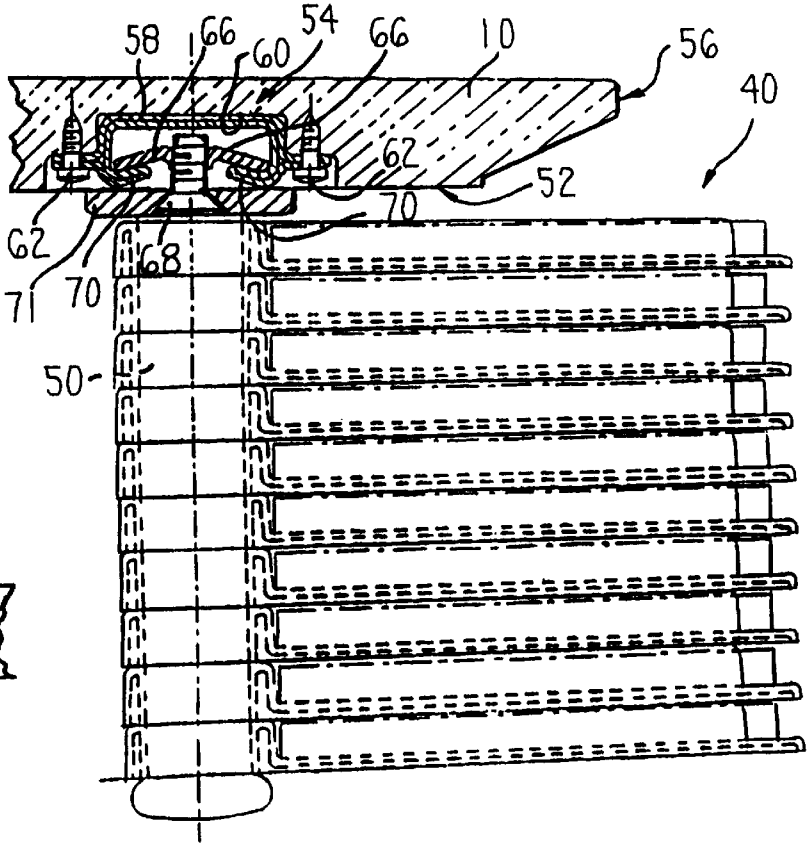
FIG. 17 is a vertical cross-section of the coupling system of an accessory directly to the underside of a worktop.
Figure 16:
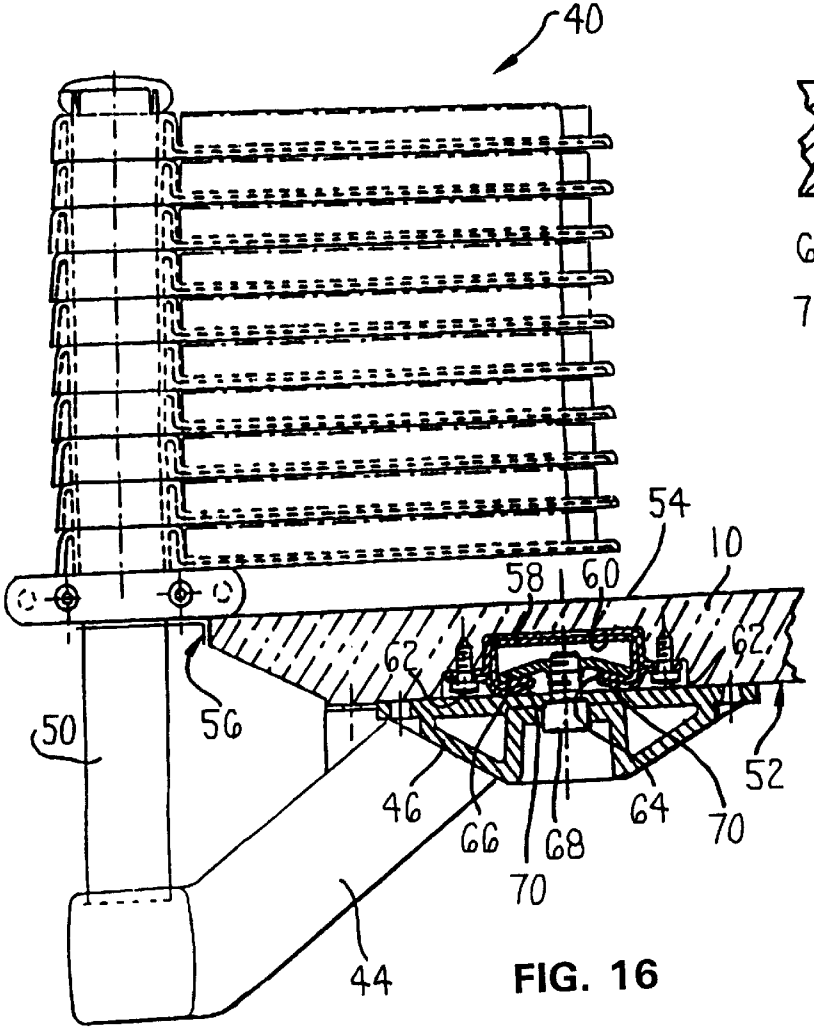
FIG. 16 is a vertical cross-section of the coupling system of the arm in the FIG. 9 to a worktop.

As can be seen better in FIGS. 16 and 17, a recessed guide 54 is fitted on the underside 52 of the worktop. This guide is by preference although not compulsorily made from a section 58, preferably in metal, with a channel cross-section, housed in a recess provided in the underside 52 of the worktop and fixed to it by means of screws 62. The section can be made, as in the examples in FIGS. 16 and 17, by bending a strip of sheeting, but extruded or drawn bars, or ones made according to the normal manufacturing techniques known in the section sector, can also be used.

The section 58 defines a lower longitudinal opening 64 into which a plate or nut 66 is inserted, preferably rectangular, narrower than the width of the opening 64, which when inserted in the section 58 is positioned transversally with respect to the opening 64 when the locking screw 68 is tightened, in order to engage with the flaps 70 adjacent to the opening 64.

In the example shown in FIG. 16, the locking screw 68, screwed to the plate 66, passes through a hole in the cup-shaped part 46 of the arm 44, which in turn holds the vertical rod 50 which supports the compact-disk holder 40. In FIG. 17, on the other hand, the rod 50 which supports the compact-disk holder is connected to a bracket 71 fixed to the underside 52 of the worktop 10 by means of the locking screw 68 screwed to the plate 66 inserted in the guide 54.

The above-described system of coupling the accessories to the linear guide recessed in the underside of the worktop makes it possible to personalise the work stations as required, allowing even non-expert personnel to attach the desired accessories to the worktop quickly and easily, or to change their position.

Figure 33:
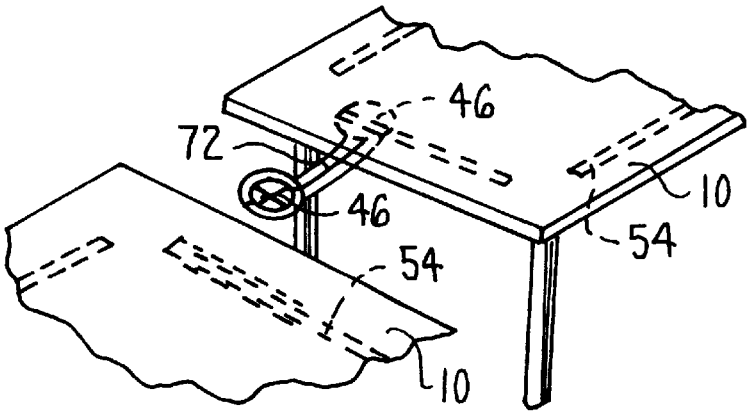
FIG. 33 is a perspective diagrammatic view of a device for the rapid or temporary coupling of adjacent worktops.

As can be seen in FIG. 33, the guides 54 can also be used to lock, temporarily or permanently, two worktops placed alongside each other, with the help of a connecting arm 72 equipped at both ends with cup-shaped parts 46 identical to that of the arm 44 in FIG. 9. Using the connecting arm 72 it is therefore possible to lock the worktops 10 shown in FIG. 3 together, which can thus be firmly joined together to form a large table.

Figure 36:
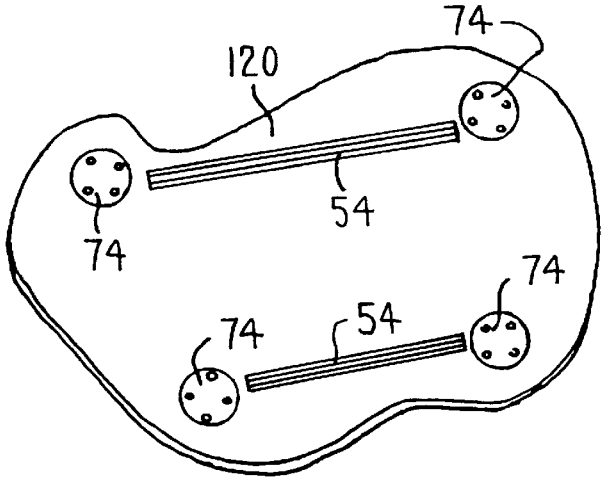
FIG. 36 is a diagrammatic view in perspective of the underside of a worktop with a freely shaped profile.

In addition to allowing the coupling of accessories, the guides 54 contribute to make the worktop 10 more rigid with respect to the bending stress, thus eliminating the need to fit supporting crossbars between the legs. As can be seen in FIG. 36, it is therefore possible to create table tops 120 with freely shaped profiles quickly and easily, since it is not necessary to respect any dimensional constraint imposed by the supporting frames generally adopted for the construction of tables according to the known technique. It is in fact sufficient to identify, on the underside of the table 120, the most appropriate areas in which to recess the leg fixing plates 74 and to mill straight lines for recessing the guides 54 between one leg and the other at the points where the bending stress is considered to be highest.

Figure 18:
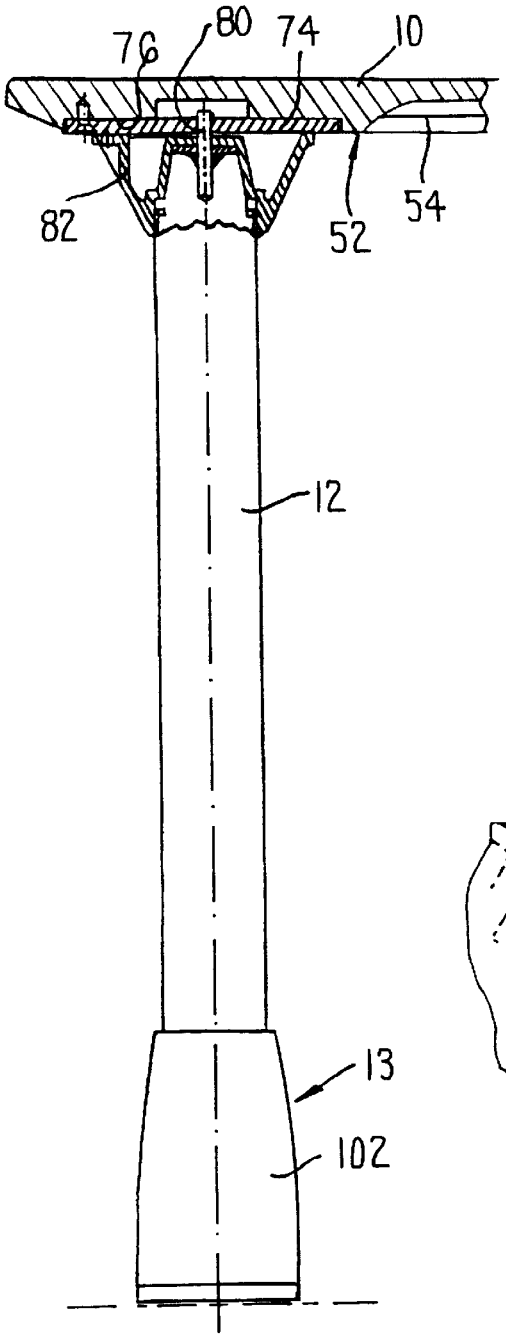
FIG. 18 is a partial cross-section elevation view of a single leg fixed to a worktop.

Each plate 74 is recessed, as can be seen in FIG. 18, in a housing 76 which corresponds in shape to the profile of the plate 74 and provided in the underside 52 of the worktop 10. The fact that the plates 74 and the guides 54 are contained within the thickness of the worktop 10 makes packaging and transport of the worktops substantially easier and cheaper, since they take up less space than the worktops of known systems. In addition, the assembly of the worktops, in a simple furniture configuration, requires only the attachment of the legs 12 (see FIG. 18) to the plates 74.

In particular, a single leg 12 is fixed to a worktop with the interposition of a cup-shaped body 82 blocked by a screw or stud bolt 80 which engages in any one of the threaded holes present in the plate 74 (see FIGS. 25*a,* 25*b*), which is in turn fixed to the worktop by means of screws passing through the holes 84.

Figure 29:
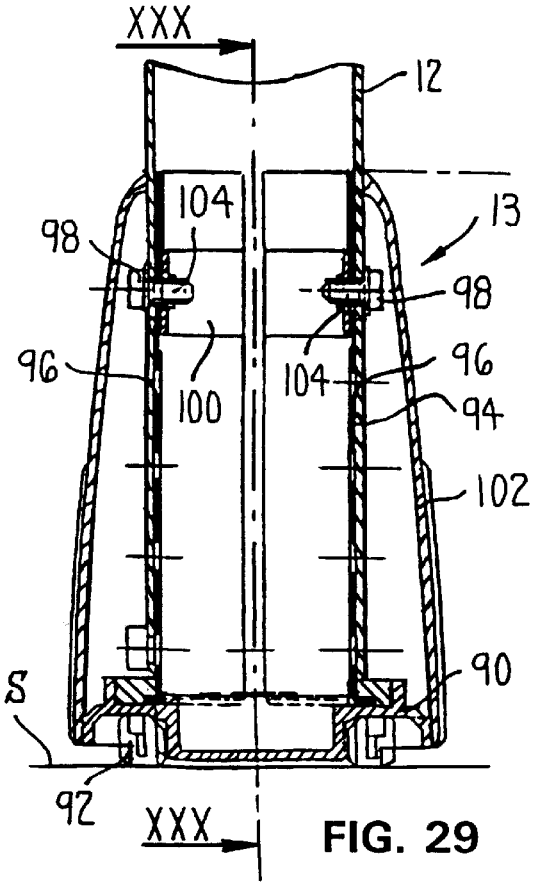
Figure 30:
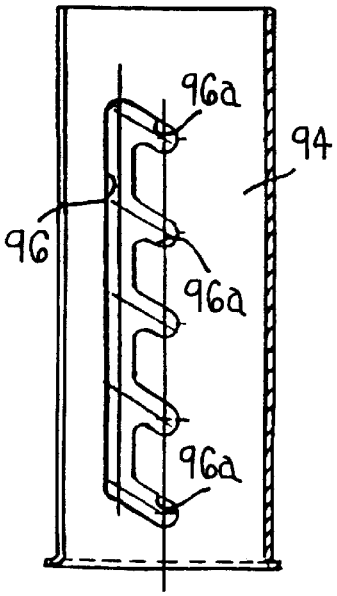
FIG. 30 is a lateral cross-section according to the line XXX—XXX of a part of the foot in FIG. 29.

The lower end of the leg 12 is fitted with an adjustable foot 13, illustrated in detail in FIG. 29. The foot 13 comprises an end part 90 on which an adjusting ring 92 is screwed for the precision-adjustment of the height of the leg 12, in order to compensate for any differences in height or irregularities in the floor S. The end portion 90 of the foot is fixed to a vertically split sleeve 94 which extends vertically inside the lower end of the tubular leg 12. As can also be seen in FIG. 30, two diametrically opposite comb-like slots 96 are provided in the sleeve 94, through which two screws 98 are screwed onto an inner split ring 100 and which, when tightened, clamp the sleeve 94 against the inner wall of the tubular leg 12. An outer casing 102 covers the foot 13 and slides up the leg 12 to allow access to the screws 98.

To modify the height of the leg 12, it is sufficient to loosen the screws 98 and turn the end part 90 of the foot 13 until the shanks 104 of the screws 98 are aligned with the vertical channel of the slots 96, so that the sleeve 94 can slide axially inside the leg 12. Subsequent rotation, in the opposite direction to the first turn, of the end part 90 returns the shanks 104 of the screws 98 inside one of the openings 96*a* of the comb-shaped slots 96.

As already pointed out, the furniture system as per this invention can be advantageously used also for the creation of complex furniture configurations, comprising worktops generally placed side by side and/or grouped together. In such furniture configurations it is more convenient and economical for adjacent worktops to share the same leg 12, both because this reduces the overall number of legs 12 necessary, and because more space is available below the worktops for the legs of the persons seated there and for the insertion of any drawer units, computers or other large containers.

Figure 19:
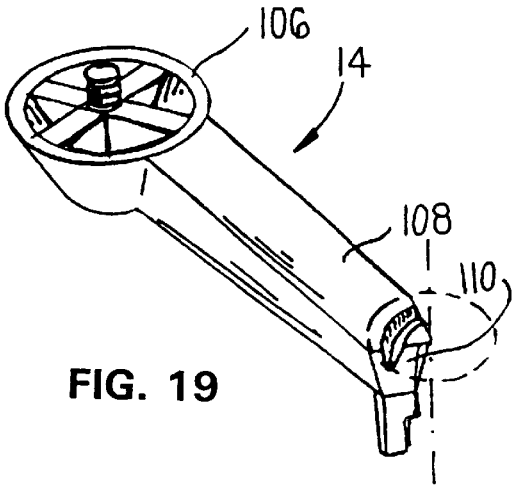
FIG. 19 is a partial cross-section elevation view of a support arm for the overhang connection of a worktop to a leg.
Figure 22:
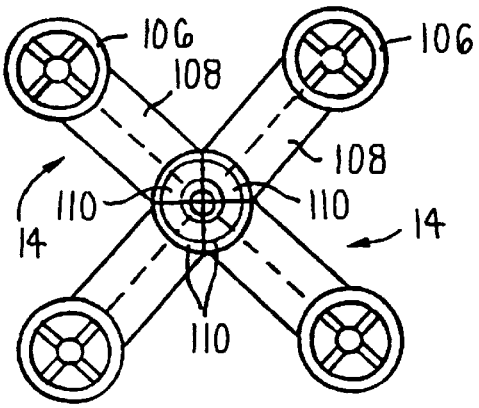
Figure 31:
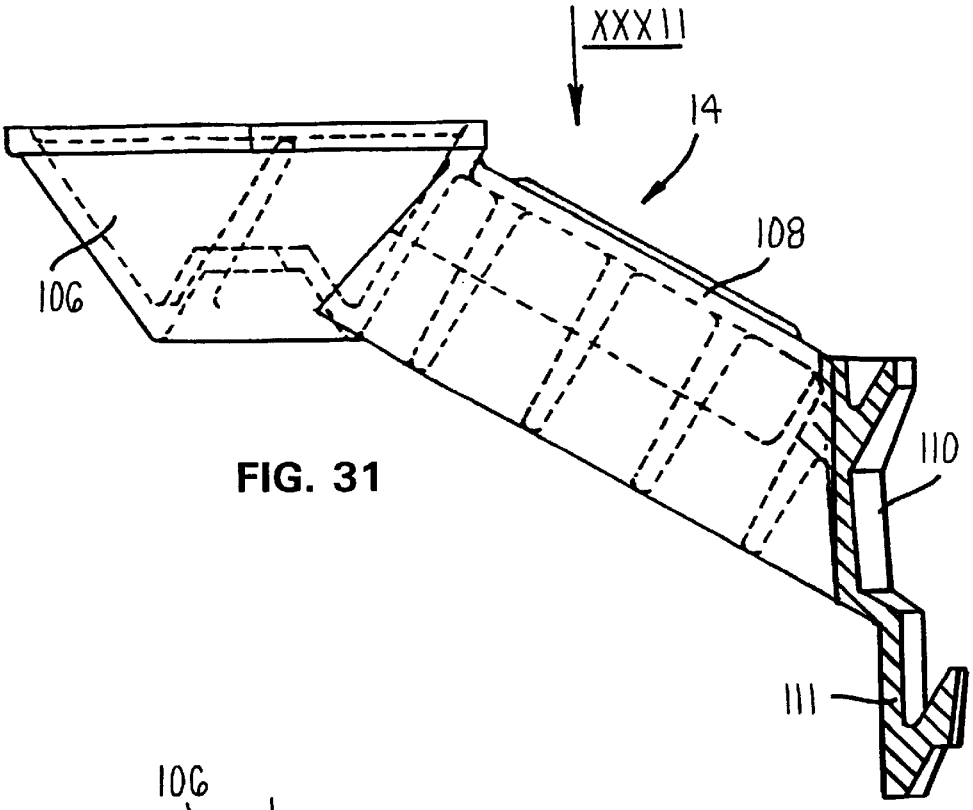
FIG. 31 is a side view of the support arm in FIG. 19.
Figure 32:
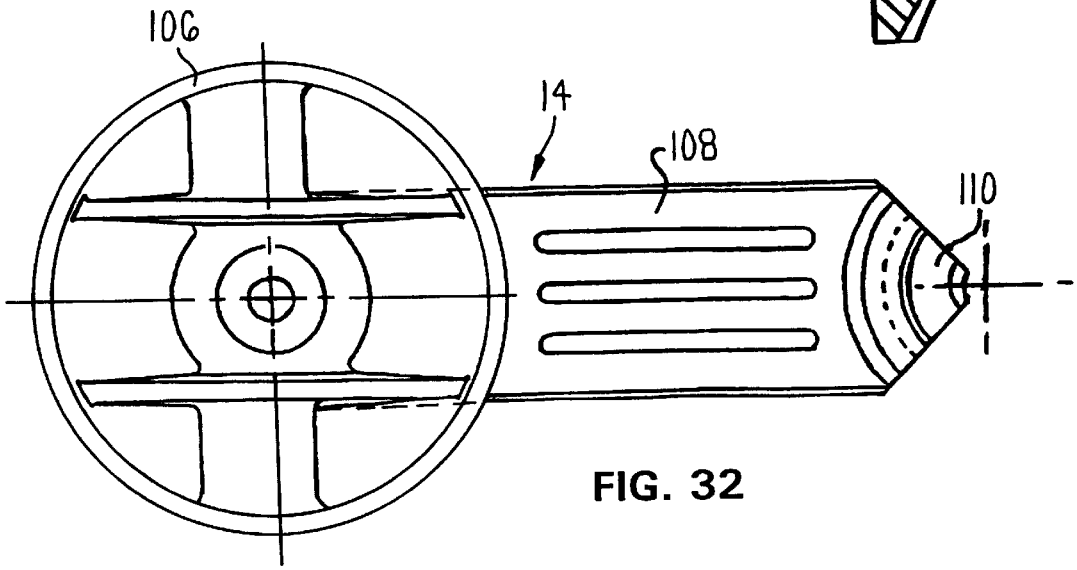
FIG. 32 is a view according to the arrow XXXII in FIG. 31.

If the same leg 12 is shared by several worktops, these are overhand mounted by means of the supports arms 14 which, as can be seen in FIG. 19 and in more detail in FIGS. 31, 32, comprise a cup-shaped portion 106 integrally connected to a downward-sloping bar 108 fitted at the end with a coupling 110 basically representing a quarter of a cylinder. It is thus possible to group the couplings 110 of four support arms 14 around a common axis, as shown in FIG. 22, so that, together, the couplings 110 form a substantially cylindrical coupling group.

Figure 20:
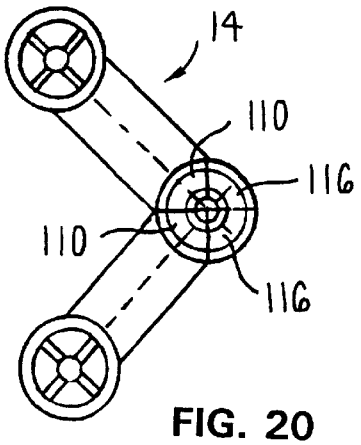
FIGS. 20 to 23 are horizontal cross-sections of possible groupings of support arms as per FIG. 19 for the assembly of a common leg.
Figure 21:
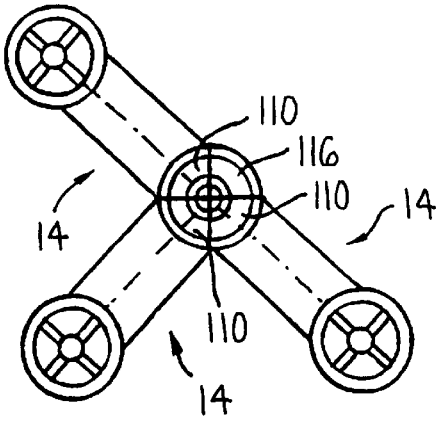
Figure 23:
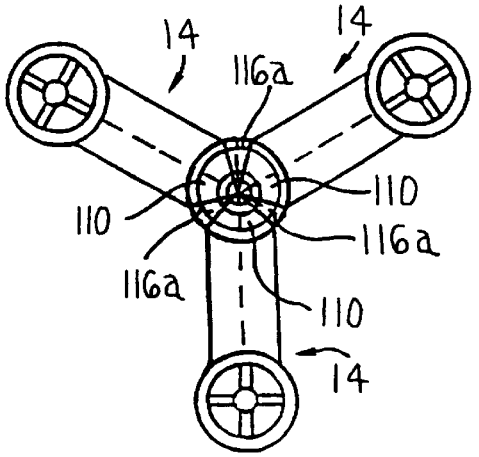

It is also possible to mount just two support arms 14 on the same leg, as shown in FIG. 20. In addition to the two support arms 14, two 90° filling sectors 116 complete the central cylindrical group inserted in the common leg 12. Only one filling sector 116 is used, as shown in FIG. 21, to complete the central cylindrical group when three support arms 14 are used in a T-shape configuration. Three support arms 14 can also be grouped in an angularly equidistant configuration, as shown in FIG. 23, for example for the common support of three 120° worktops illustrated in FIG. 2. In this case the central cylindrical group is completed with 30° sectors 116*a*.

Figure 24:
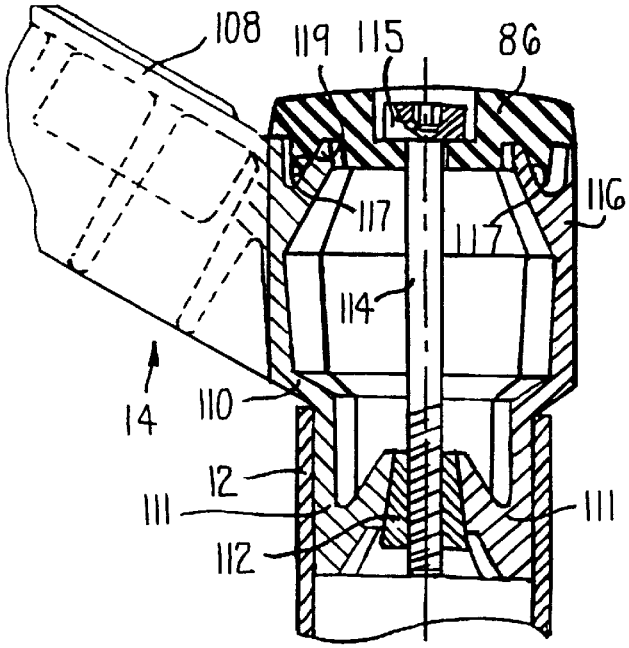
FIG. 24 is a vertical cross-section illustrating a detail of the assembly of a support in FIG. 19 to a leg.

FIG. 24 shows an example of how the couplings 110 are clamped to the leg 12. The lower portions 111 of the couplings 110 and the filling sections 116, 116*a,* joined together to form an axially bored cylindrical group, are inserted in the upper end of the tubular leg 12 and are pressed against its inner wall by a frustoconical expansion organ 112 into which the end of a traction screw 114 is screwed, the head 115 of which presses on a cover 86. The sloping wall 117 of the upper portion of the couplings 110 and the filling sectors 116, 116*a* interact with a corresponding sloping wall 119 of the cover 86.

When the central screw 114 is tightened, the wedge 112 presses radially against the couplings 110*a,* forcing them against the inner wall of the tubular leg 12, while the sloping wall 119 of the cover 86 forces the upper parts of the couplings 110 and the filling sectors 116, 116*a* against each other. Alternatively, the cover 86 can be replaced by a vertical extension 15 (see FIGS. 1 and 2) to which the screw 114 is firmly fixed.

Figure 25B:
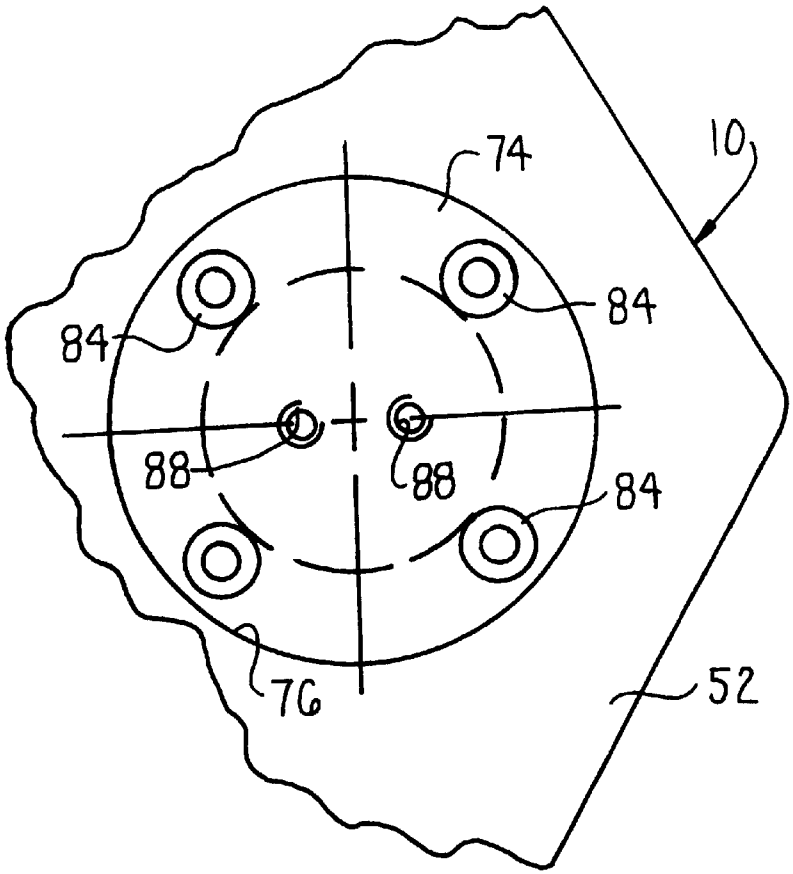
FIGS. 25*a* and 25*b* are enlarged scale views of the lower part of 90° and 120° worktop corners, equipped with plates for leg fitting.
Figure 25A:
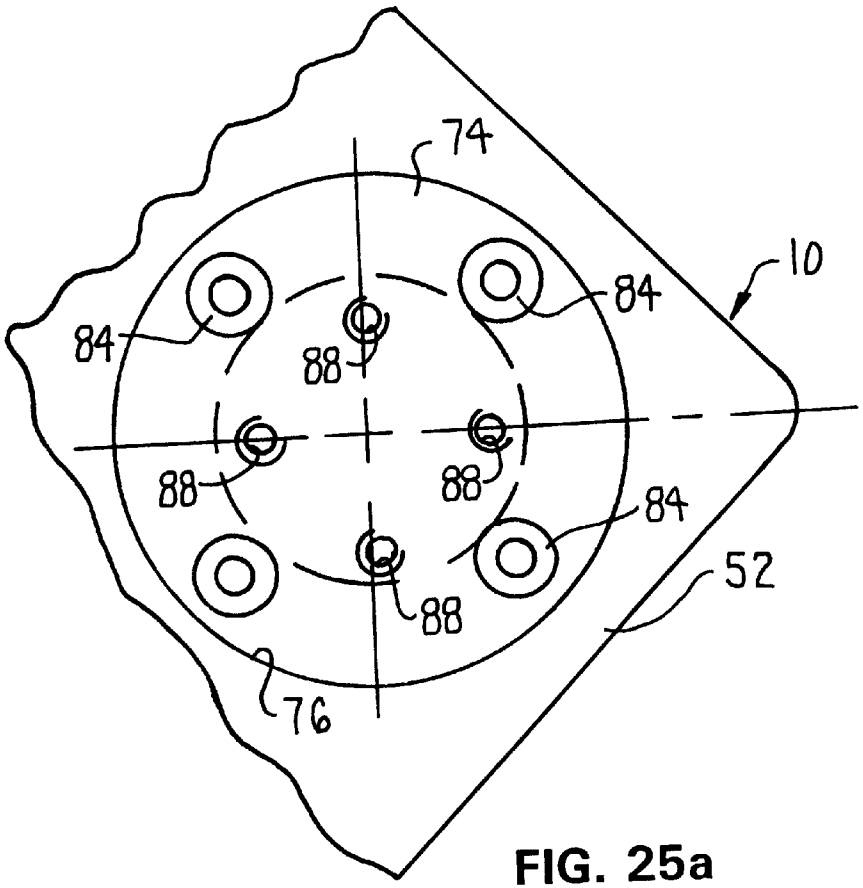

When the worktops are overhang mounted on the legs 12 by means of the support arms 14, the cup-shaped parts 106 of the arms can be fixed to the plates 52 by means of a central screw which engages in one of the threaded holes 88 cut in the plate 74 (see FIGS. 25*a,* 25*b*). The choice of the threaded hole 88 for the fixing screw of the cup-shaped part 106 determines the relative position of each worktop 10 with respect to the adjacent one, as can be seen in FIGS. 27*a* to 27*d,* which show the plates 74 with four threaded holes 88 like the one illustrated in FIG. 25*a,* on each worktop.

Figure 27A:
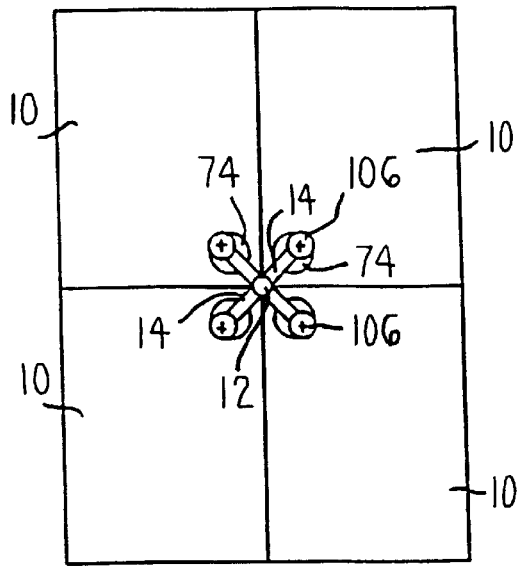
Figure 27B:
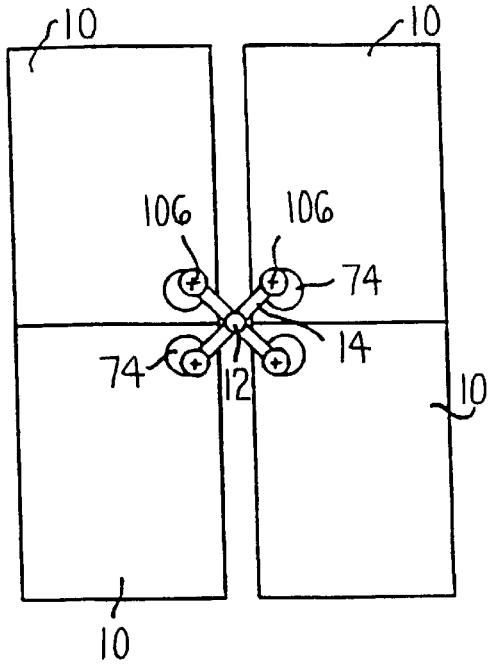
Figure 27C:
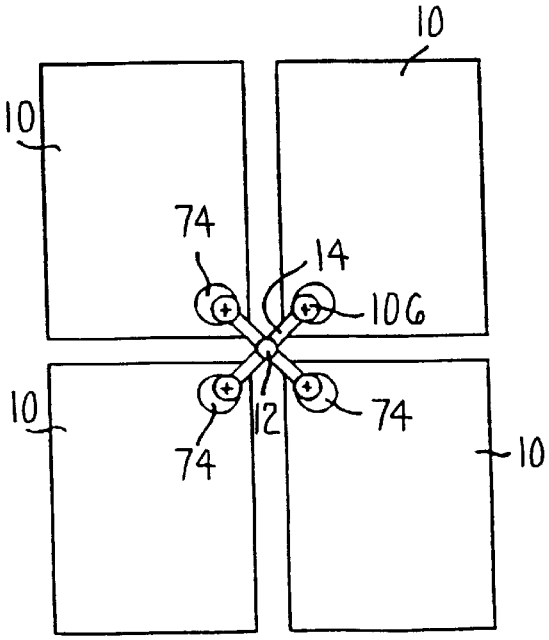
Figure 27D:
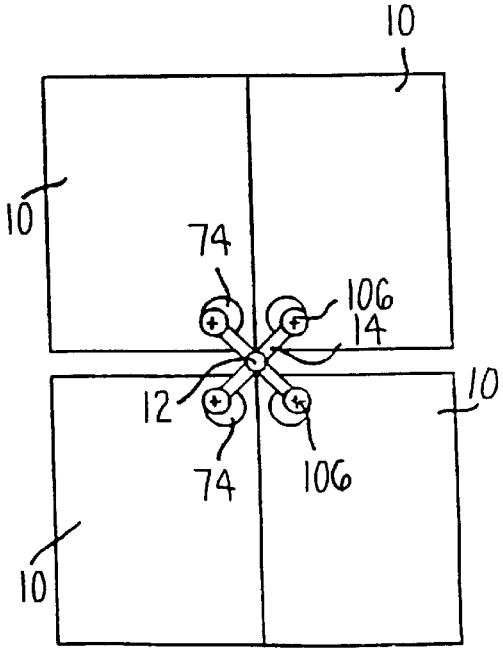

In particular, it is possible to create furniture configurations in which several worktops 10 are placed side by side to form a larger working surface, as shown in FIG. 27*a,* or the four worktops can be separated from each other as in FIGS. 1 and 27*c*. Other possible worktop combinations are illustrated in FIGS. 27*b* and 27*d,* in which pairs of adjacent worktops are placed next to each other in one direction and separated in the other direction at right angles to the first.

Figure 28:
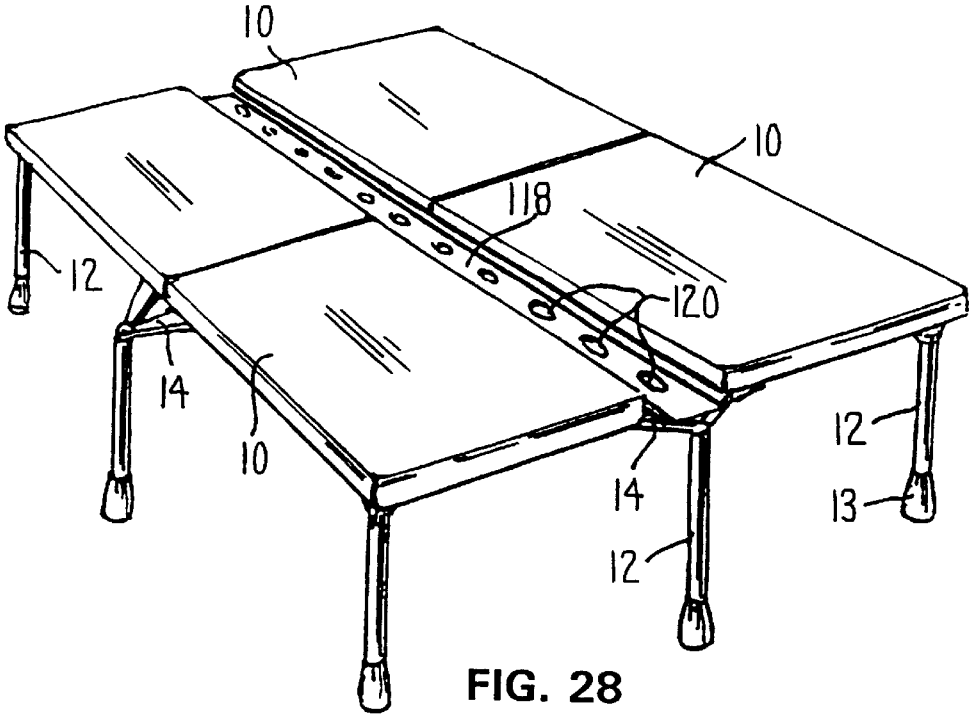
FIG. 28 is a perspective view of the configuration of worktops as per FIG. 27*b*, showing the presence of a tray for housing cables, electrical sockets and the like, FIG. 29 is a longitudinal cross-section of the adjustable foot of the leg in FIG. 18.

The furniture configuration illustrated diagrammatically in FIG. 27*b* is also shown in perspective in FIG. 28, in which is possible to note that the space separating the pairs of worktops 10 can be advantageously used to house a channel for electrical cables. Thanks to the fact that the support arms 14 slope, the channel 118 can be recessed or, at most, flush with respect to the surface of the worktops 10. A plurality of openings 120 allows the support rods to pass through for the accessories which can then be fixed under the worktops 10, such as for example the separation screen described above. One advantage of the furniture configuration shown in FIG. 28 comprising the channel 118 is, for example, the possibility of being able to quickly position all the office machine power cables, and any multiple power points, even after the system has been assembled, without necessarily having to bend down under the worktops 10. The cables supported by the channel are also easily accessible for inspection and maintenance and can be quickly replaced.

Figure 26:
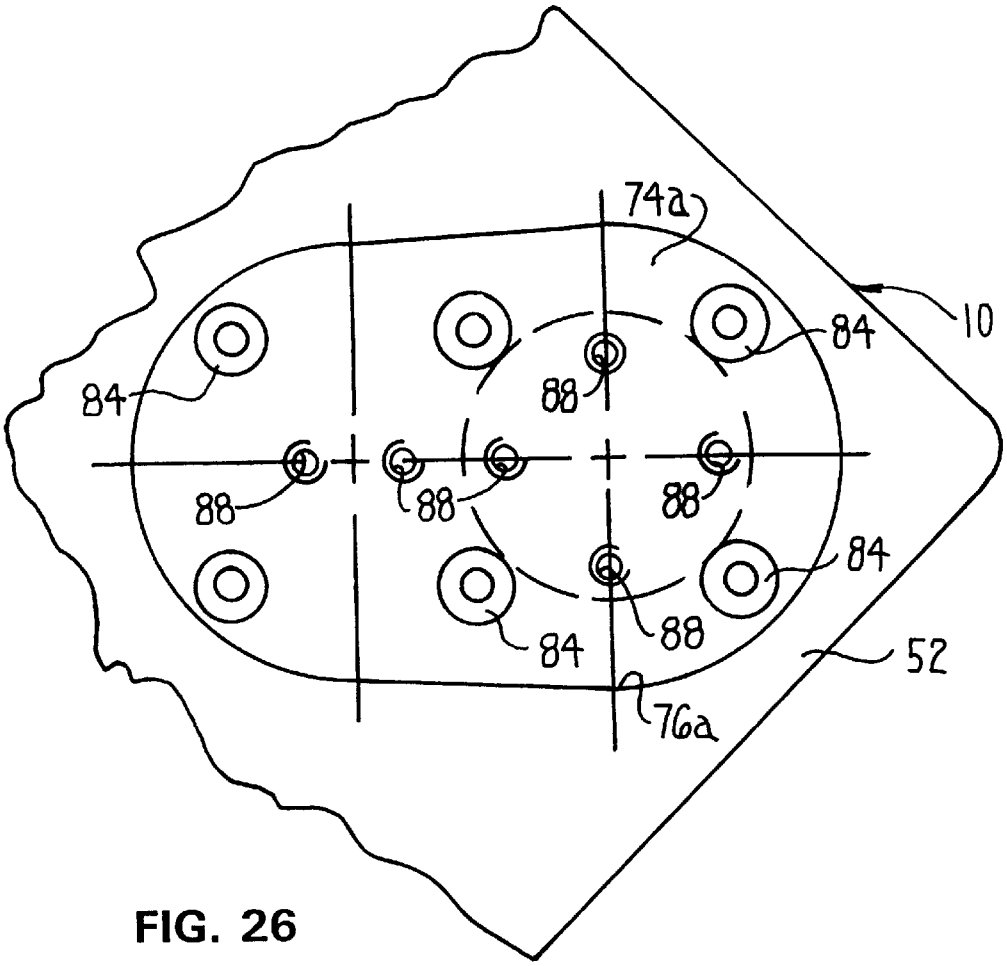
FIG. 26 is a view of a combined plate with the same function as those shown in FIGS. 25*a* and 25*b*, FIGS. 27*a*, 27*b*, 27*c* and 27*d* are diagrammatic views from below of four possible configurations of worktops in which a single central leg is shared by the worktops.

FIG. 25*b* shows a plate 74 that can be used near a 120° corner of a worktop. In this case, only two threaded holes 88 are necessary for the assembly of two adjacent worktops, either placed next to each other or separated. FIG. 26 shows an elongated variation of the plate 74*a* combining the arrangement of the threaded holes 88 of the plates in FIGS. 25*a,* 25*b,* for 90° and 120° worktops respectively. In addition to providing a unification of the plates necessary for the modular combination of 90° and 120° worktops, the elongated form also makes it easier to position the plate 74*a* correctly in the corresponding elongated housing 76*a* cut in the underside 52 of the worktop 10. The need to check the angular orientation of the plate, and in particular of the threaded holes 88, with respect to the edge of the worktop, is in fact completely eliminated. It is only necessary to turn the elongated plate 74*a* in one direction or the other, depending on whether the corner of the worktop 10 is 90° or 120°.

Figure 34:
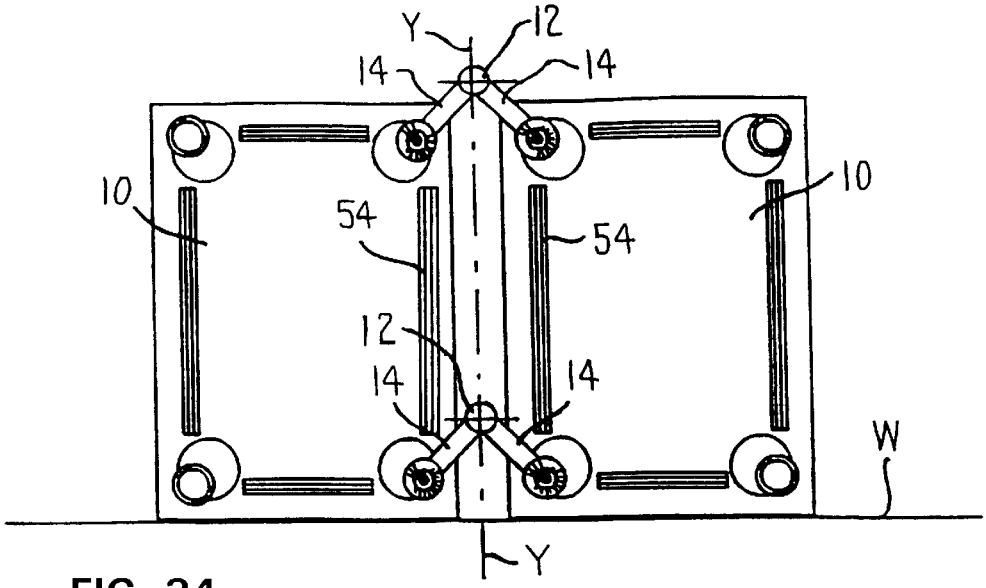
FIG. 34 is a diagrammatic view from below of a pair of worktops coupled together so they can be placed against a wall.

FIG. 34 illustrates an additional advantageous characteristic of the furniture system as per this invention. If the same leg 12 supports two worktops, the support arms 14 can be turned either outwards or inwards with respect to the worktops. In the latter case, it is therefore possible to place the worktops against a wall W without wasting any space for the leg 12. The axis of the leg 12 is however always positioned in line with the vertical plane Y—Y in FIG. 34, the same plane on which the support rods of the accessories fixed to the guides 54 closest to the plane Y—Y are found, in order to respect the modularity of the furniture system.

Figure 35:
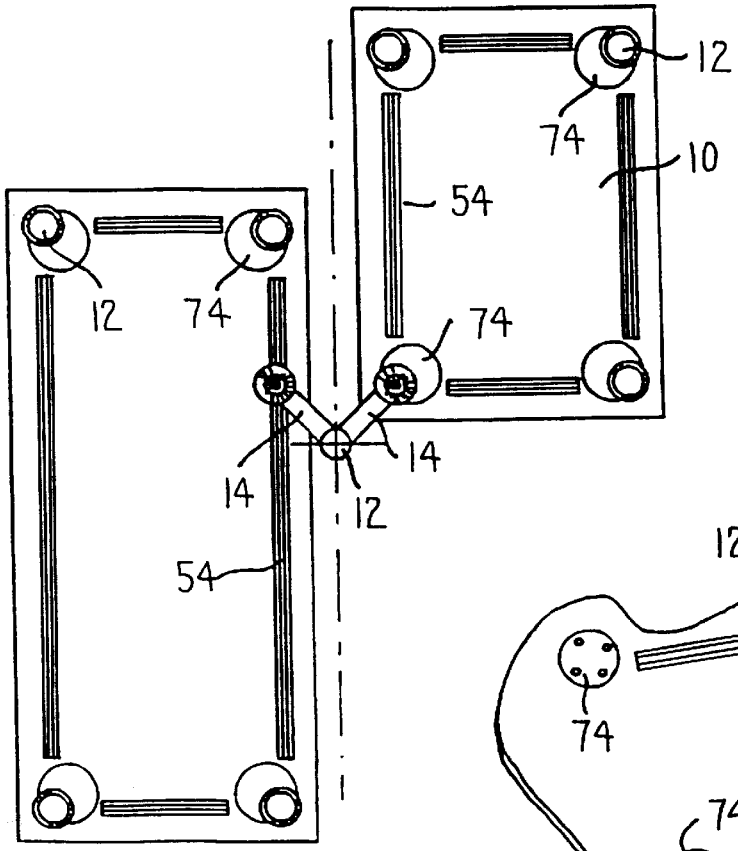
FIG. 35 is a diagrammatic view from below of a furniture configuration comprising a pair of staggered worktops coupled together.

The fact that the guides 54 are arranged at a distance from the edge of the modular worktops 10 so as to respect the modularity defined by the support arms 14, means that it is also possible to create unusual furniture configurations, such as for example the one illustrated in FIG. 35, in which two worktops are staggered with respect to each other and one of the support arms 14 protruding from the common leg engages in the guide 54 simply by using a plate 66 identical to the one illustrated in FIGS. 16 and 17.

Naturally, the possible furniture configurations that can be created with this system are countless, it being possible to expand the system according to a basically horizontal development by merely selecting the number and shape of worktops required. Since the creation of a furniture configuration is not tied to the prior creation of support frame structures, each furniture configuration can be easily modified any number of times, even without the need for specialised personnel.

The simplicity of attaching and moving the accessories with respect to the worktops by means of the guides 54 also makes it possible to personalise each work station as required, quickly adapting it to the working requirements of each person concerned.

The configuration flexibility of complex furniture systems provided by the use of the plates 74, 74*a* with multiple threaded holes 88 and by the support arms 14, together with the position of the guides 54 which reflects the modularity defined by the dimensions of the support arms 14, of the arms 44 for the accessories and by the position of the threaded holes 88 in the plates 74, 74*a*, are all elements which make it possible to create furniture systems that can be easily adapted to any type of environment.

Without prejudice to the principle of the invention, the embodiments and the realization details can naturally vary widely without going beyond the framework of this invention.

What is claimed is:

1. A furniture system comprising at least one worktop mounting thereon a plurality of legs to support the one worktop from a support surface, the one worktop including a plurality of support plates fixed to an underside thereof in predetermined positions, comprising the improvement wherein an elongate linear guide is fixed to the underside of the one worktop between at least two of the support plates and close to one edge of the worktop, the support plates and the linear guide being mounted in recesses defined in the underside of the one worktop.

2. The furniture system according to claim 1 wherein the linear guide is channel-shaped in transverse cross-section.

3. A furniture system according to claim 1 including at least one accessory and a coupling member which engages with the linear guide for fixing the accessory to the worktop in any longitudinal position along the linear guide.

4. A furniture system according to claim 3 wherein the linear guide defines an elongate channel therein, the coupling member including engagement means selectively insertable into and movable within the channel and a clamp which locks the engagement means within the channel at a selected position therealong.

5. A furniture system according to claim 3 wherein the linear guide includes a downwardly-opening channel-section defined by a pair of generally upright side walls and a pair of flanges which extend generally transversely inwardly from lower edges of the respective side walls, the flanges having inner opposed edges which together define a longitudinally extending slot, and the coupling member includes a plate which is engaged within the channel-section so as to traverse the slot thereof and a clamping element which locks the plate within the channel-section at a selected position and engages the plate with the respective flanges, the clamping element being releasable so as to permit positional adjustment of the plate along the channel-section.

6. A furniture system according to claim 5 including at least one accessory mounted to the worktop so as to be positioned adjacent and above an edge thereof, and an elongate support arm which is angled relative to the horizontal and includes a cup-shaped portion at one end thereof and supports the accessory adjacent an opposite end thereof, the clamping element cooperating with the cup-shaped portion to mount the arm at a selected position along the linear guide at the underside of the worktop.

7. A furniture system according to claim 6 wherein the opposite end of the support arm is socket-shaped for receiving an elongate and generally vertically oriented rod which projects upwardly and mounts the accessory thereon in a position above the worktop.

8. A furniture system according to claim 5 including at least one accessory mounted to the worktop so as to be positioned generally adjacent an edge thereof and below the worktop, an elongate and generally vertically oriented rod which projects downwardly from the underside of the worktop and is fixed thereto by a bracket which cooperates with the clamping element, the rod mounting the accessory thereon.

9. A furniture system according to claim 1 including a pair of the worktops, an elongate connecting arm having respective mounting elements at opposite ends thereof, and a pair of coupling members which interconnect the respective mounting elements of the connecting arm to the linear guides of the respective worktops to interconnect same in side-by-side relation with one another.

10. A furniture system according to claim 1 wherein each leg includes a foot at a lowermost end thereof, each foot including a first adjustment mechanism for making fine adjustments in the vertical height of the respective leg, and a second adjustment mechanism for making coarse adjustments in the vertical height of the respective leg.

11. A furniture system according to claim 10 wherein the foot of each leg includes a tubular wall, and the second adjustment mechanism includes a sleeve which is disposed in a telescoping manner within the tubular wall and a clamping element which releasably clamps the sleeve against the tubular wall, the sleeve including a guide arrangement which cooperates with the clamping element, the clamping element being positionally adjustable along the guide arrangement to effectively adjust the position of the sleeve relative to the tubular wall and selectively increase or decrease the height of the respective leg.

12. A furniture system according to claim 11 wherein the guide arrangement includes at least one opening within the sleeve which is defined by an elongate and vertically oriented first slot and a plurality of second slots which communicate with the first slot and project sidewardly therefrom in vertically spaced relation with one another, the clamping element being positionable within one of the second slots to selectively increase or decrease the height of the respective leg.

13. A furniture system according to claim 1 including a plurality of elongate support arms for mounting the worktop on the respective legs, each support arm including a support portion at one end thereof which is fixed to one of the support plates, an intermediate portion which is angled with respect to the horizontal, and a coupling portion at an opposite end thereof which is mounted to an upper end of a respective leg.

14. A furniture system according to claim 1 including at least two of the worktops which are supported by a common leg, and first and second elongate support arms for mounting the two worktops on the common leg, each support arm including a support portion at one end thereof, a coupling portion at an opposite end thereof, and an intermediate portion which extends therebetween, the support portion of the first support arm being fixed to one of the support plates on one worktop and the support portion of the second support arm being fixed to one of the support plates on the other worktop, and the coupling portions of the first and second support arms both engaging within an upper tubular end of the common leg to mount the respective support arms thereon.

15. A furniture system according to claim 14 wherein the intermediate portions of the respective support arms are angled relative to the horizontal such that the common leg is spaced laterally outwardly from the two worktops.

16. A furniture system according to claim 15 wherein the coupling portions of the respective support arms are each configured as complementary pie-piece shaped sectors, with the sectors being combined with at least one pie-piece shaped filler sector and grouped about a common vertical axis to together form an upright and generally cylindrical coupling group, the coupling group having a lower small diameter end which engages within the upper tubular end of the common leg and defines a generally central and vertically oriented opening for receiving a clamping member which fixes the coupling group within the upper tubular end.

17. A furniture system according to claim 16 wherein the coupling group defines an upper sloped wall and a lower frustoconical wall, the clamping member including an upper compression element with a sloped wall and a lower frustoconical expansion element which are interconnected via an elongate fastener, wherein upon manipulation of the fastener the upper compression element and the lower expansion element are moved toward one another which causes the lower expansion element to press against the lower frustoconical wall to force the small diameter end against the upper tubular end of the common leg, and the sloped wall of the upper compression element to press against the upper sloped wall of the coupling group to force the respective sectors against one another exteriorly of the common leg.

18. A furniture system according to claim 15 wherein the support arms position the two worktops adjacent one another such that respective substantially straight edges thereof are opposed to one another, the respective support plates defining a plurality of predetermined mounting locations thereon, the support portions of the respective arms being fastenable to the respective support plates at a selected mounting location to rigidly join the two worktops together so that the edges thereof are either disposed in abutting or horizontally spaced relation relative to one another.

19. A furniture system according to claim 18 wherein the respective support plates include at least one pair of diametrically opposed threaded holes each of which defines a respective mounting location, the support portions of the respective arms being fixed to the respective support plates via a threaded fastener engaged within one of the threaded holes.

20. A furniture system according to claim 18 wherein a pair of horizontally spaced common legs support the two worktops via respective pairs of first and second support arms and the two tables are rigidly joined together so that the edges thereof are disposed in horizontally spaced relation from one another, and an elongate channel member is disposed in an elongate spaced defined between the respective opposed edges of the two worktops, the channel member being at least partially supported by the respective pairs of support arms.

21. A furniture system comprising at least one worktop which mounts thereon a plurality of legs to support the worktop in upwardly spaced relation from a support surface, the worktop including a plurality of support plates fixed to an underside thereof in predetermined positions and a plurality of support arms for mounting the worktop on the respective legs, each support arm including a support portion which is fixed to one of the support plates and a coupling portion opposite the support portion which engages within an upper end of a respective leg, comprising the improvement wherein the furniture system includes at least two of the worktops supported by a pair of the support arms on at least one common leg, each support plate defining a plurality of predetermined mounting locations thereon, the respective support portions of the pair of support arms being fastenable to a respective support plate at a selected mounting location thereon to rigidly join the two worktops together in adjacent relation so that respective opposed edges thereof are disposed in flush or separated relation from one another.

22. A furniture system according to claim 21 wherein a pair of horizontally spaced common legs support the two worktops via respective pairs of support arms and the respective support portions of the pairs of support arms are each fastened to the corresponding support plate at a selected mounting location to join the two worktops together so that the opposed edges thereof are disposed in separated relation from one another, and a channel member is disposed in a space defined between the respective opposed edges of the two worktops, the channel member being at least partially supported by the respective pairs of support arms engaged within the respective common legs.

23. A furniture system according to claim 21 wherein each support plate defines therein at least one pair of diametrically opposed mounting holes, each mounting hole defining a mounting location, the respective support portions of the pair of support arms being fixed to the respective support plates via an elongate fastener engaged within one of the mounting holes.

24. A furniture system comprising a worksurface supported in upwardly spaced relation from a support surface by a plurality of generally upright legs, a plurality of support plates which are recessed into the underside of the worksurface in predetermined positions for mounting an upper end of a respective upright leg or a support arm which mounts the worksurface on the respective leg, and an elongate linear guide which extends generally longitudinally along a terminal edge of the worksurface and is recessed into the underside thereof generally between two of the support plates, the guide reinforcing the worksurface against bending and defining a coupling area for connection of an accessory to the worksurface.

25. A furniture system according to claim 24 including an accessory and a coupling member, the guide defining a downwardly opening channel therein in which the coupling member is slidably horizontally movable to permit mounting of the accessory at a selected location along the terminal edge of the worksurface.

26. A furniture system according to claim 25 including a plurality of the worksurfaces and a plurality of the support arms, wherein at least two of the worksurfaces are supported by a common upright leg by a first and a second of the support arms, the first and second support arms each including a support portion defined at one end thereof and a mounting portion defined at an opposite end thereof, the support portion of the first support arm being fastened to a support plate of one of the worksurfaces and the support portion of the second support arm being fastened to a support plate of the other worksurface, the mounting portion of the respective first and second support arms both being engaged within an open upper end of the common upright leg, and the first and second support arms being supportable on the common upright leg in angular relation with one another to permit positioning of the two worksurfaces in multiple angular positions relative to one another.

27. A furniture system according to claim 26 wherein three or more worksurfaces are supported by a common upright leg by a corresponding number of the support arms with the respective support potions thereof each being fastened to a support plate of one of the worksurfaces and the respective mounting portions thereof all being engaged within an open upper end of the common upright leg.

28. A furniture system according to claim 26 wherein the support plates are mounted adjacent terminal edge portions of the respective worksurfaces and each of the support plates defines a plurality of mounting holes therein which are horizontally and diametrically spaced from one another, the support portions of the respective support arms being fastened to a selected mounting hole of a respective support plate by a threaded fastener to permit the two worksurfaces to be arranged so that respective terminal edges thereof are disposed in either spaced or abutting relation with one another.

29. A furniture system according to claim 26 wherein each support arm includes an intermediate elongate part disposed between and interconnecting the respective support portion and mounting portion thereof, the intermediate elongate part being angled relative to the horizontal so that the support portion and mounting portion respectively define upper and lower terminal ends of the support arm which are spaced both vertically and horizontally from one another with the common upright leg being spaced laterally outwardly from the two worksurfaces.

* * * * *